United States Patent [19]

Stephens

[11] 4,296,574

[45] Oct. 27, 1981

[54] FLOOR PANEL-FURNITURE SUPPORT SYSTEM

[75] Inventor: William I. Stephens, Telford, Pa.

[73] Assignee: Knoll International, Inc., New York, N.Y.

[21] Appl. No.: 86,751

[22] Filed: Oct. 22, 1979

Related U.S. Application Data

[63] Continuation of Ser. No. 877,619, Feb. 14, 1978, abandoned.

[51] Int. Cl.[3] ..... E04F 15/024

[52] U.S. Cl. ..... 52/27; 52/220; 52/126; 52/263

[58] Field of Search ..... 52/27, 36, 220, 84, 52/126, 263; 174/48, 49; 297/15

[56] References Cited

U.S. PATENT DOCUMENTS

| | | | |
|---|---|---|---|
| 2,025,395 | 12/1935 | Lehn | 297/15 |
| 3,317,009 | 6/1974 | Elder | 52/84 |
| 3,977,497 | 8/1976 | MacMurray | 187/17 |

FOREIGN PATENT DOCUMENTS

| | | |
|---|---|---|
| 976192 | 11/1964 | United Kingdom . |
| 1284281 | 8/1972 | United Kingdom . |
| 1335829 | 10/1973 | United Kingdom . |
| 1340036 | 12/1973 | United Kingdom . |
| 1460111 | 12/1976 | United Kingdom . |

*Primary Examiner*—James L. Ridgill, Jr.

[57] ABSTRACT

A floor panel-furniture support system utilizing a plurality of floor panels supported by a support means above a base floor. The floor panels rest freely upon the support means in non-attached relationship therewith, and include as part thereof means for supporting a furniture item. In a floor panel system, an item of furniture may replace one or more of the floor panels and be supported by the floor panel support means.

6 Claims, 11 Drawing Figures

Fig. 1.
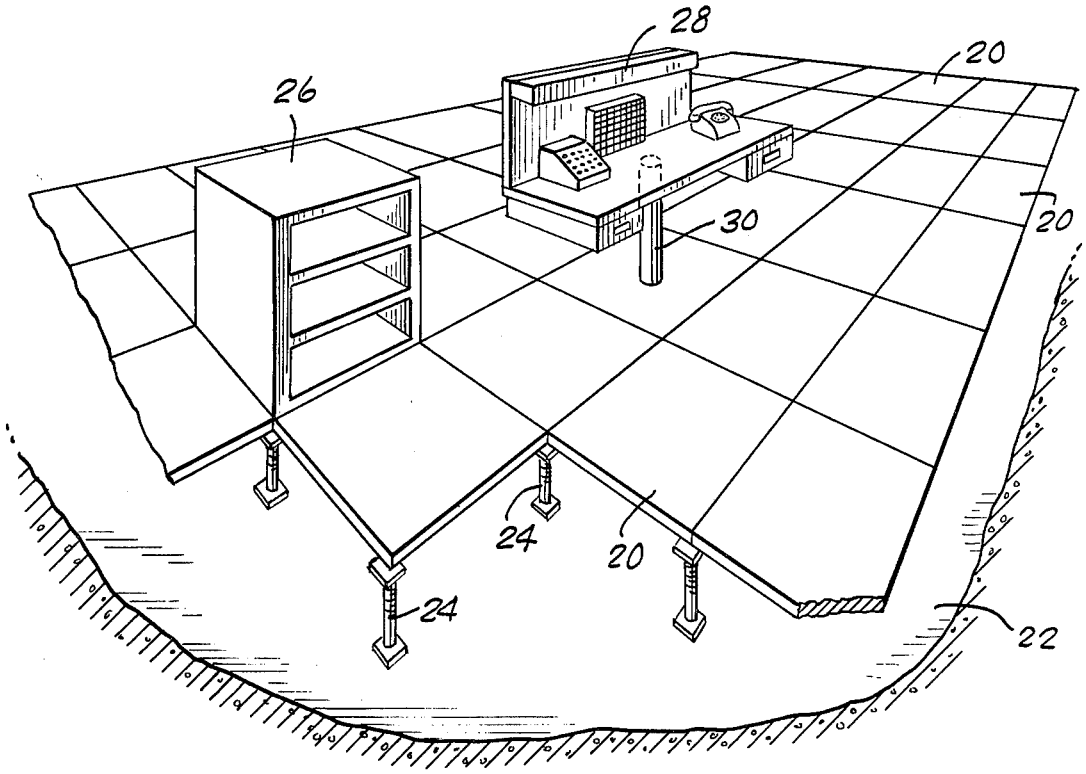
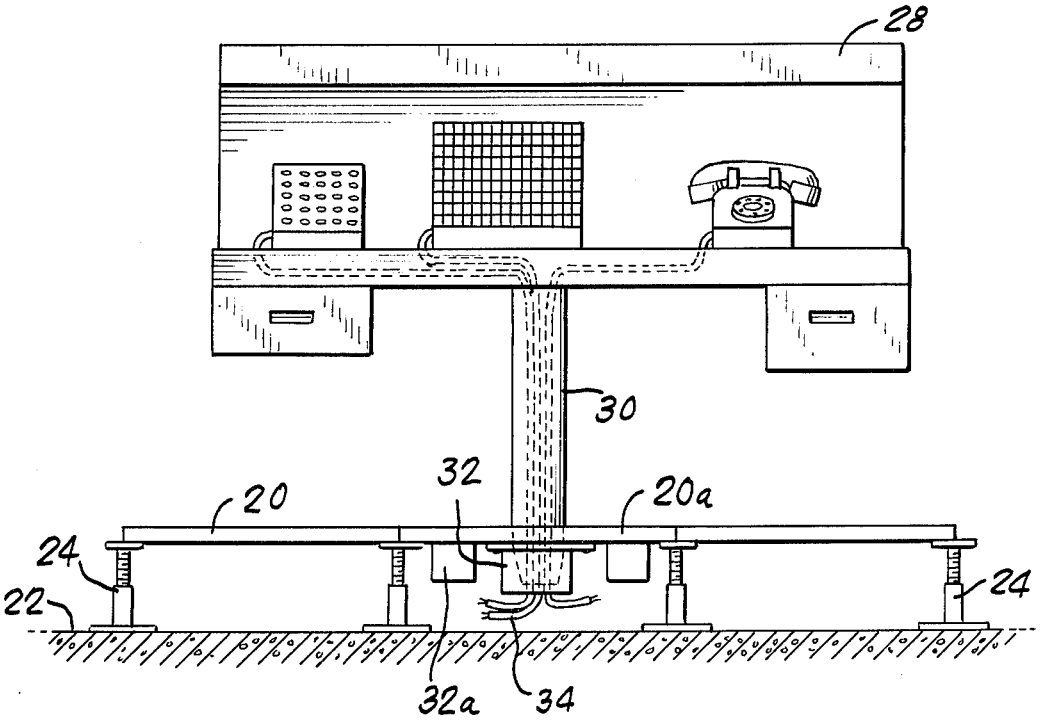
Fig. 2.

Fig. 3.
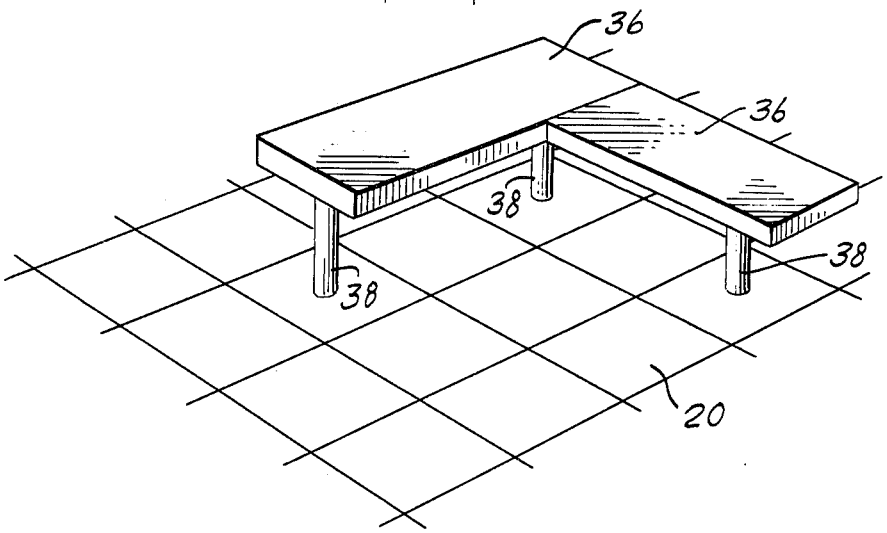
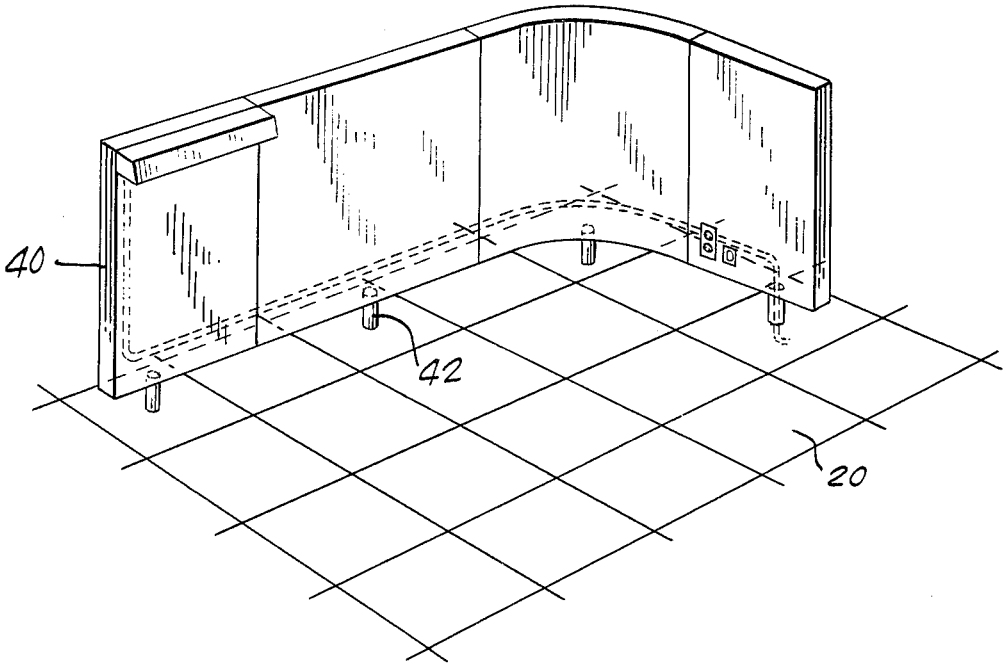
Fig. 4.

Fig. 5.
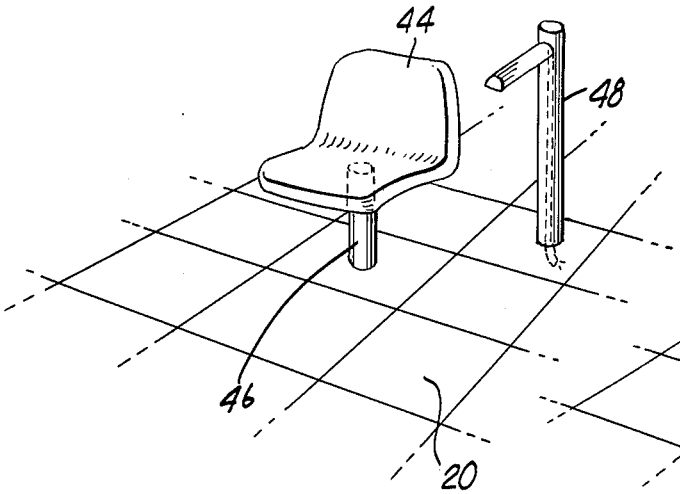
Fig. 8.
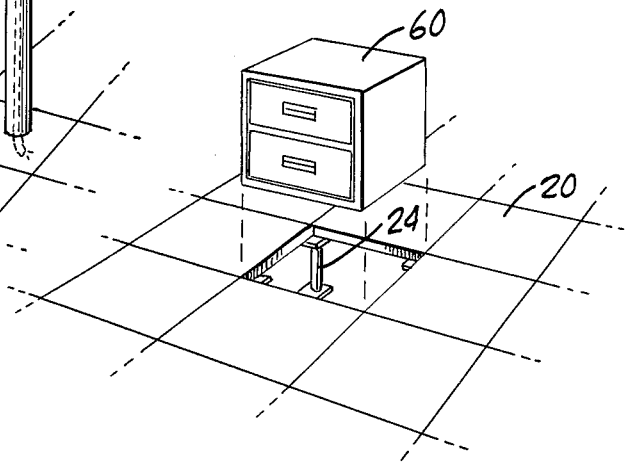
Fig. 6.
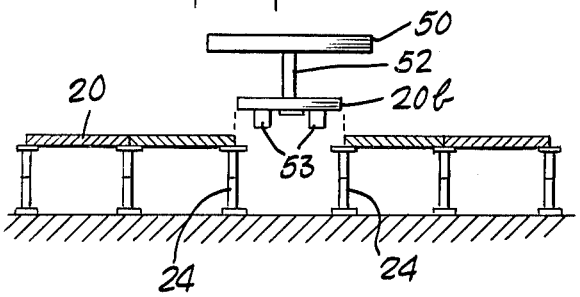
Fig. 9.
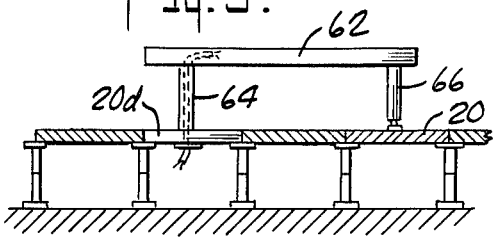
Fig. 7.
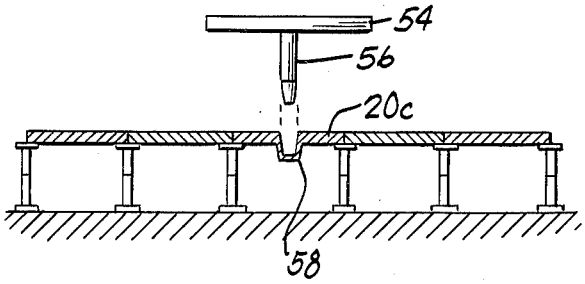
Fig. 10.
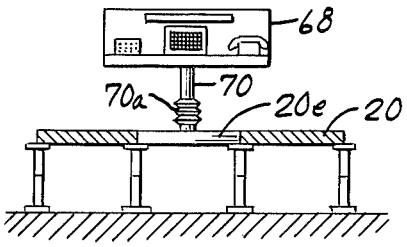
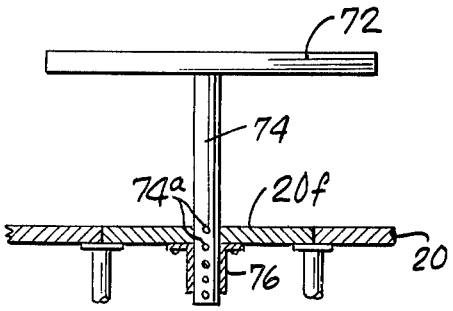
Fig. 11.

FLOOR PANEL-FURNITURE SUPPORT SYSTEM

This is a continuation, of application Ser. No. 877,619 filed Feb. 14, 1978, now abandoned.

BACKGROUND AND BRIEF DESCRIPTION OF THE INVENTION

This invention relates to furniture systems, and more particularly provides a combined floor panel and furniture support system.

The invention has particular application to and is especially suitable for use with a raised floor system. Raised floors are typically used at the present time in computer installations, communication systems, offices, laboratories, and other rooms requiring convenient access to utilities. Examples of such raised floor systems are disclosed in the following patents:

| U.S. Pat. No. | Patentee | Issue Date |
|---|---|---|
| 4,016,357 | Abrahamsen | 5 April 1977 |
| 3,924,370 | Cauceglia et al | 9 December 1975 |

Such raised or elevated flooring systems typically employ floor panels arranged in a grid. Such a floor panel system provides a unique environment for the positioning of furniture, and the present invention combines such a raised floor panel system with the furniture itself to produce a highly versatile furniture system. In particular, by combining items of furniture with the floor panels, the furniture-panel combination can be moved and replaced with a minimum of effort. Utilities, which are present underneath the floor panels, can be easily piped to the furniture items.

In the present invention the furniture item-floor panel combined system is achieved by utilizing floor panels which rest freely upon the support means that supports the floor panels above a base floor. The floor panels include as a part thereof means for supporting furniture items, such as furniture pedestals and the like, which may easily accommodate utilities piped to the furniture item through the pedestal from the space between the floor panel and the base floor. Additionally, an item of furniture may replace one or more of the floor panels and be supported by the floor panel support system.

In the Abrahamsen patent cited above, computer units are positioned within a raised floor structure, but they are supported directly upon and by the base floor. In the Cauceglia et al patent cited above, raised floor panels are utilized for supporting electronic equipment; however, such floor panels are rigidly attached to the beams forming a part of the floor panel support system, and the desired flexibility of change is not easily achieved.

The following additional patents are of interest:

| U.S. Pat. No. | Patentee | Issue Date |
|---|---|---|
| 3,918,225 | Fisher et al | 11 November 1975 |
| 3,770,334 | Weber | 6 November 1973 |
| 3,462,105 | Kohrt | 19 August 1969 |
| 3,189,140 | Luss | 15 June 1965 |
| 3,055,061 | Dadras | 25 September 1962 |

Fisher et al disclose the use of modular floor systems involving modular floor elements, each of which can be individually lifted to and supported at preset heights to change the configuration of the floor. Provision is made to releasably secure furniture items to the floor elements; the floor elements are not removable and replaceable.

Kohrt discloses the use of pins to anchor church pews in place. Replaceable floor panels are not utilized or suggested.

Luss discloses a floor pinning system for posts in an office partitioning system of the same general type as in the Kohrt patent just referred to. The posts extend through ceiling openings. A modular floor panel system is not disclosed or suggested.

Dadras discloses a changeable interior wall building construction in which wall elements may be pinned into sockets within a floor. A modular raised floor panel system in combination with such elements is not disclosed or suggested.

Weber discloses running utilities through a pedestal; there is no suggestion of such a system for use in a raised floor system.

The present invention thus marries the raised floor panel system with the furniture supported thereby, permitting simple shifting or replacement of the furniture items. Any change of a furniture item is accompanied by a concomittant change in the associated floor panel.

The invention will be more completely understood by reference to the following detailed description.

BRIEF DESCRIPTION OF THE DRAWING

FIG. 1 is a perspective view of a system embodying the invention.

FIG. 2 is a front view, to an enlarged scale, of one of the furniture item-floor panel assemblies shown in FIG. 1.

FIGS. 3 to 5 are perspective views of further systems embodying the invention.

FIGS. 6 and 7 are front views, partly in section, showing the details of systems embodying the invention.

FIG. 8 is a perspective view, partly exploded, illustrating one of the aspects of the invention.

FIGS. 9 to 11 are front views, partly in section, illustrating systems embodying the invention.

DETAILED DESCRIPTION

Referring to FIG. 1, a plurality of floor panels 20 are shown, supported in position above a base floor 22 by support means 24. The support means 24 may be any conventional support system for supporting panels 20 as a raised floor above the base floor 22, such as disclosed in the Cauceglia et al patent cited above or as made and sold by Weber Architectural Products Division/Walter Kidde & Company, Inc. and Liskey Aluminum, Inc., as disclosed in the following brochures:

(1) "WEBER Raised Flooring Systems", Bulletin 204, (11L/We), A.I.A. File No. 23-C-1;

(2) "LISKEY Pedestal Floors", No. 13, October 1968.

Forming a part of the floor panel system, as will be described in more detail below, are items of furniture 26 and 28. The furniture item 26 constitutes a bookcase while the furniture item 28 constitutes a desk supported by a pedestal 30.

The desk 28 and pedestal 30 are shown in more detail in FIG. 2 with respect to the marrying of that furniture item with the floor panel system. In this case, pedestal 30 extends through associated floor panel 20*a* and is secured to the underside of that floor panel by an attachment 32. The floor panel 20*a* rests freely upon the support means 24 in non-attached relationship therewith. As shown in FIG. 2, the floor panel 20*a* includes as a part thereof the attachment 32 which serves as a means for supporting the pedestal 30 and desk 28. That attachment 32 may be weighted, if desired, or separate weights 32*a* may be employed, to render stable the furniture item-floor panel combined assembly.* As shown in FIG. 2, the pedestal 30 and attachment 32 may be hollow, to acommodate utilities 34, such as electrical wiring, extending from the space between the base floor 22 and the raised floor panels 20 to the desk 28 to service the items on the desk, such as a telephone, calculating machine and the like.

*Stability will be provided by the floor panel alone if it is large enough in size.

FIG. 3 shows in perspective view a similar system, in this case tables 36 which include pedestals or hollow columns 38 that form part of floor panels 20. Another system is shown in perspective view in FIG. 4, involving space dividers or panels 40 supported by pedestals or hollow columns 42 that form parts of the panel system 20.

FIG. 5 shows another system involving a chair 44 and pedestal 46, as well as lamp 48, all part of floor panel system 20.

FIG. 6 shows a table 50, including pedestal 52 that is attached to and forms a part of floor panel 20*b*.* The entire combination of table 50, including pedestal 52 and attached floor panel 20*b* simply rests freely upon support structures 24. Thus the table-floor panel combination can be easily moved within a room or replaced, as desired, with a plain floor panel 20 replacing the table-floor panel combination.

*Weights 53 may be attached to the underside of panel 20*b*, if needed for stability.

FIG. 7 shows a similar table 54 and accompanying pedestal 56, in this case adapted to be supported by a socket 58 that forms a part of floor panel 20*c*.

FIG. 8 shows a filing cabinet 60 which replaces one of the floor panels 20 and is supported directly by the support means 24. It will be appreciated that the filing cabinet or similar furniture item may replace one or more floor panels.

In FIG. 9, table 62 includes a pedestal 64 which is attached to a floor panel 20*d* in the same fashion as described above in connection with FIG. 6. Another leg of the table 66 simply rests upon conventional raised floor panel 20.

In FIG. 10 a desk 68 and accompanying pedestal 70 are combined with floor panel 20*e*. In this case, the pedestal 70 may include a system within bellows 70*a* for adjusting the height of the desk above the raised floor panels 20.

In FIG. 11, a table 72 and pedestal 74 are shown combined with floor panel 20. A socket 76 is secured to the underside of and forms a part of the floor panel 20*f* and receives the pedestal 74. The pedestal 74 may include holes 74*a* in the lower portion thereof to permit the pinning of the pedestal to the supporting socket 76 at various heights of the table above the raised floor panel system 20.

From the above description it will be noted that a marrying of furniture items and floor panels has been provided by the representative but presently preferred embodiments described. It is obvious that modifications may be made in these preferred embodiments. Hence, the invention should be taken to be defined by the following claims.

I claim:

1. In a floor panel system that includes a plurality of floor panels, and support means positioned upon a fixed base floor supporting said floor panels in fixed position above said base floor, the improvement in which at least one of said floor panels rests upon said support means in freely-removable relationship therewith and includes as an operatively interconnected part thereof means for holding and supporting a furniture item.

2. A floor panel-furniture support system according to claim 1, wherein said furniture item support and holding means comprises a socket for receiving a pedestal that forms a part of said furniture item.

3. A floor panel-furniture support system according to claim 1, wherein said at least one floor panel is weighted to render it stable in supporting said furniture item.

4. A floor panel-furniture support system according to claim 1, wherein said furniture item support and holding means comprises a pedestal for said furniture item.

5. A floor panel-furniture support system according to claim 4, wherein said pedestal is hollow for the passage of one or more utilities therethrough.

6. In a floor panel system that includes a plurality of individual floor panels, support means positioned upon a fixed base floor supporting said floor panels in fixed position above said base floor, the improvement in which at least one of said floor panels is replaced by an item of furniture supported directly by said support means.

* * * * *